US008430460B2

(12) United States Patent
Erro et al.

(10) Patent No.: US 8,430,460 B2
(45) Date of Patent: Apr. 30, 2013

(54) MERCHANDISING PLATFORM AND HANDLE APPARATUS FOR A MERCHANDISER

(75) Inventors: Estefania Erro, Pamplona (ES); Asier Esnal, Orio (ES)

(73) Assignee: Hussmann Corporation, Bridgeton, MO (US)

( * ) Notice: Subject to any disclaimer, the term of this patent is extended or adjusted under 35 U.S.C. 154(b) by 59 days.

(21) Appl. No.: 13/097,597

(22) Filed: Apr. 29, 2011
(Under 37 CFR 1.47)

(65) Prior Publication Data

US 2012/0104921 A1 May 3, 2012

Related U.S. Application Data

(60) Provisional application No. 61/329,847, filed on Apr. 30, 2010.

(51) Int. Cl.

| | |
|---|---|
| ***A47F 3/04*** | (2006.01) |
| ***A47F 3/00*** | (2006.01) |
| ***F25D 11/00*** | (2006.01) |
| ***E05D 15/26*** | (2006.01) |
| ***B65D 51/18*** | (2006.01) |
| ***A47J 45/00*** | (2006.01) |
| ***G05G 1/10*** | (2006.01) |
| ***B62D 1/06*** | (2006.01) |

(52) U.S. Cl.
USPC ..... 312/116; 312/139.2; 49/125; 220/254.6; 220/254.3; 16/414; 74/553; 74/557

(58) Field of Classification Search ..... 312/304, 312/116, 138.1, 139.2, 109, 349, 348.6; 16/414, 16/441, 425, 422, 110.1; 49/125; 220/764, 220/763, 762, 760; 74/553–557, 543–551
See application file for complete search history.

(56) References Cited

U.S. PATENT DOCUMENTS

| | | | | |
|---|---|---|---|---|
| 2,216,467 | A | 10/1940 | Falk | |
| 2,788,236 | A | 4/1957 | Kafowi | |
| 2,793,925 | A * | 5/1957 | Rosen | 312/139.2 |

(Continued)

FOREIGN PATENT DOCUMENTS

| | | |
|---|---|---|
| DE | 202008006746 | 7/2008 |
| DE | 102007047305 | 4/2009 |

(Continued)

OTHER PUBLICATIONS

Image of Pennant merchandiser, from http://www.pennantcommercialequiprnent.com.au/images/PM60G-Pie-Merchandiser.jpg, known as early as Jul. 2, 2010, 1 page.

*Primary Examiner* — Janet M Wilkens
*Assistant Examiner* — Andrew Roersma
(74) *Attorney, Agent, or Firm* — Michael Best & Friedrich LLP

(57) ABSTRACT

A merchandiser includes a case defining a product display area, and a lid disposed over the product display area and substantially enclosing at least a portion of the product display area. The lid is movable between an open position providing access to the product display area and a closed position limiting access to the product display area. The merchandiser also includes a handle assembly that has a handle coupled to and rotatable relative to the lid as the lid moves between the open position and the closed position.

7 Claims, 11 Drawing Sheets

U.S. PATENT DOCUMENTS

| | | | | | |
|---|---|---|---|---|---|
| 2,998,993 | A | | 9/1961 | North et al. | |
| 3,077,100 | A | | 2/1963 | Gerlach | |
| 3,313,057 | A | * | 4/1967 | Leddy | 40/331 |
| 3,410,247 | A | | 11/1968 | Dronberger | |
| 4,108,515 | A | | 8/1978 | Johnson | |
| 4,559,796 | A | * | 12/1985 | De Forrest, Sr. | 70/432 |
| 4,592,604 | A | * | 6/1986 | Wilke | 312/245 |
| 4,593,430 | A | * | 6/1986 | Spangler et al. | 16/441 |
| 4,608,882 | A | | 9/1986 | Howie, Jr. | |
| 4,616,673 | A | * | 10/1986 | Bondar | 137/315.15 |
| 4,776,296 | A | | 10/1988 | Heermans | |
| 4,862,552 | A | | 9/1989 | Remmel | |
| 5,509,174 | A | * | 4/1996 | Worrell | 16/441 |
| 5,513,831 | A | * | 5/1996 | Seward | 251/96 |
| 5,724,771 | A | * | 3/1998 | Gipson | 49/449 |
| 5,810,372 | A | * | 9/1998 | Arendt | 280/33.992 |
| 5,996,285 | A | * | 12/1999 | Guillemet et al. | 49/213 |
| 6,242,064 | B1 | | 6/2001 | Howie, Jr. | |
| 6,438,771 | B1 | * | 8/2002 | Donath et al. | 4/678 |
| 6,487,752 | B1 | * | 12/2002 | Mathews | 16/86 B |
| 6,528,001 | B1 | | 3/2003 | Howie, Jr. | |
| 6,687,957 | B2 | | 2/2004 | Worrell | |
| 6,834,430 | B2 | | 12/2004 | Worrell | |
| 7,163,455 | B2 | * | 1/2007 | Ogawa et al. | 454/69 |
| 7,213,849 | B2 | * | 5/2007 | Weinberg et al. | 292/336.3 |
| 2005/0052099 | A1 | * | 3/2005 | Behr et al. | 312/139.2 |
| 2006/0032025 | A1 | * | 2/2006 | Hendrickson | 16/444 |
| 2006/0242790 | A1 | * | 11/2006 | Lauterbach | 16/93 R |
| 2007/0062210 | A1 | | 3/2007 | Miller, Jr. et al. | |
| 2008/0129164 | A1 | | 6/2008 | Walsh | |

FOREIGN PATENT DOCUMENTS

| | | |
|---|---|---|
| EP | 1248177 | 10/2002 |
| EP | 1879094 | 1/2008 |
| JP | 2009275974 | 11/2009 |
| WO | 2006060490 | 6/2006 |
| WO | 2010012477 | 2/2010 |

* cited by examiner

MERCHANDISING PLATFORM AND HANDLE APPARATUS FOR A MERCHANDISER

RELATED APPLICATIONS

This patent application claims priority to U.S. Provisional Patent Application Ser. No. 61/329,847 filed Apr. 30, 2010, the entire content of which is hereby incorporated by reference.

BACKGROUND

The present invention relates to refrigerated merchandisers, and more particularly, to refrigerated merchandisers including a merchandising platform, lids for accessing a product display area of the merchandiser, and handles for moving the lids between open and closed positions.

In conventional practice, commercial businesses such as supermarkets and convenience stores are equipped with vertically-oriented and horizontally-oriented refrigerated merchandisers. Some refrigerated merchandisers include doors or lids that are movable between open and closed positions to provide access to the product display areas in the merchandisers. Often, handles are rigidly fixed to the doors using fasteners or other attachment means to allow movement of the doors between the open and closed positions.

SUMMARY

In one construction, the invention provides a merchandiser including a case that defines a product display area, and a lid that is disposed over the product display area and substantially encloses at least a portion of the product display area. The lid is movable between an open position providing access to the product display area and a closed position limiting access to the product display area. The merchandiser also includes a handle assembly that has a handle coupled to and rotatable relative to the lid as the lid moves between the open position and the closed position.

In another construction, the handle has an opening adjacent the top of the handle, and the handle assembly further includes a cap that is engaged with the handle and that substantially encloses the opening. The cap has advertising information that is visible from outside the case.

In another construction, the invention provides a merchandiser including a case that defines a product display area, a first lid disposed over a portion of the product display area, and a second lid disposed over a portion of the product display area. Each of the first lid and the second lid is movable between an open position providing access to the product display area and a closed position limiting access to the product display area. The second lid is located adjacent the first lid, and the first lid and the second lid cooperate with each other to enclose the product display area. The second lid is oriented on the case so that the second lid is at least partially disposed under the first lid when one or both of the first lid and the second lid are moved toward the open position. The merchandiser also includes a first handle assembly that has a first handle coupled to and rotatable relative to the first lid as the first lid moves between the open position and the closed position, and a second handle assembly that has a second handle coupled to and rotatable relative to the second lid as the second lid moves between the open position and a closed position. The first handle and the second handle are oriented such that a top of the first handle and a top of the second handle are at the same height above a support surface of the merchandiser.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
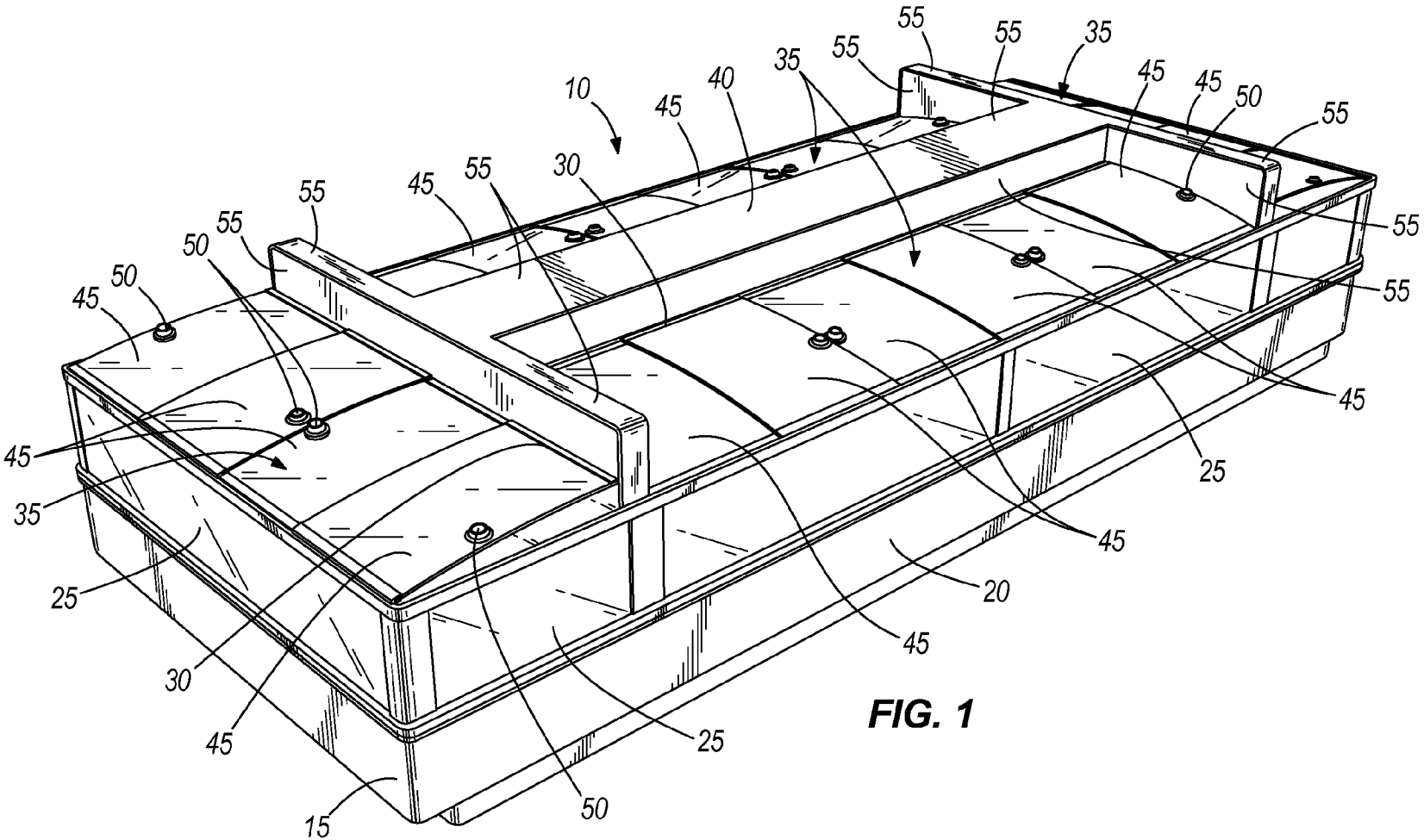
FIG. 1 is a perspective view of an exemplary merchandiser including a merchandising platform, lids, and handle assemblies embodying the invention.
Figure 2:
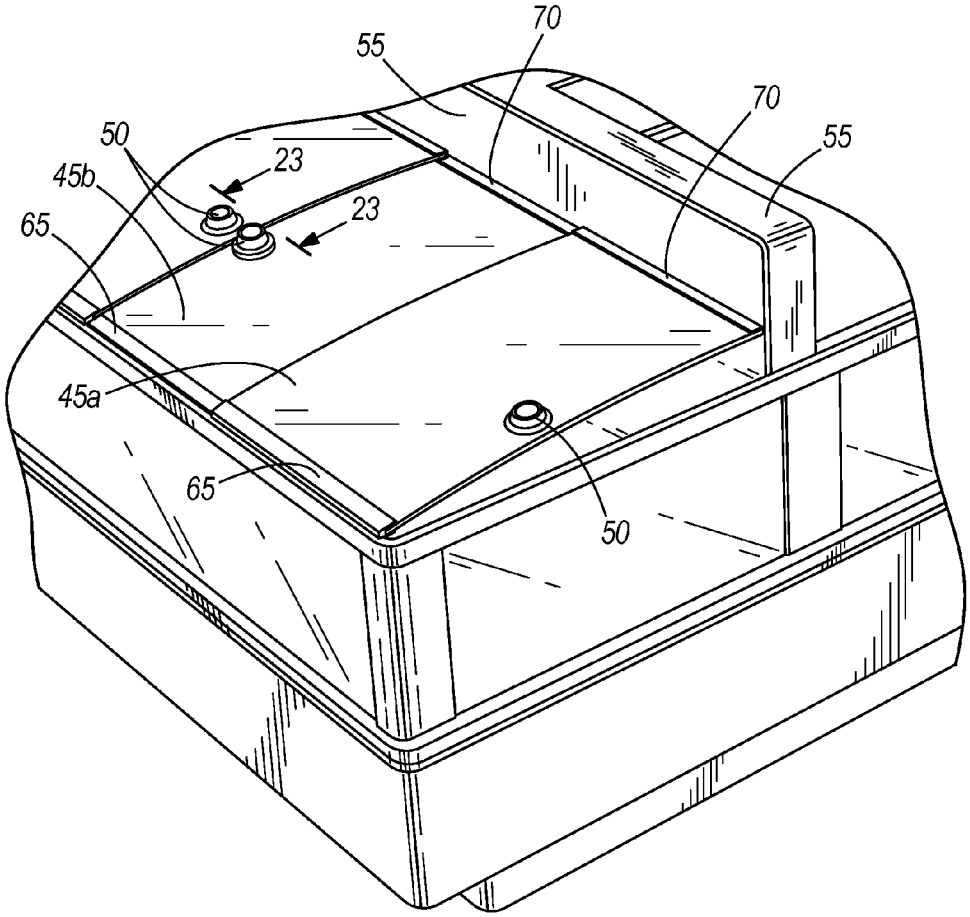
FIG. 2 is a partial perspective view of some of the merchandiser of FIG. 1 including the merchandising platform, the lids, and the handle assemblies.

FIGS. 1 and 2 show a merchandiser 10 that displays food product (e.g., frozen food, beverages, etc.) available to consumers in a retail setting (e.g., a supermarket or grocery store). The merchandiser 10 includes a case 15 that has a base 20, side panels 25, and internal walls 30 that define product display areas 35. In the illustrated construction, the merchandiser 10 includes four product display areas 35. In other constructions, fewer or more than four product display areas 35 may be provided. At least a portion of a refrigeration system (not shown) can be located within the case 15 to refrigerate the food product.

FIGS. 1 and 2 show that the merchandiser 10 also includes a merchandising platform 40 coupled to the case 15, lids 45 disposed over the product display areas 35 to substantially enclose the product display areas 35, and handle assemblies 50. The merchandising platform 40 is coupled to a top of the case 15 and is positioned over the internal walls 30. In some constructions, the merchandising platform 40 is formed as part of the internal walls 30 that extend above the lids 45. As illustrated in FIG. 1, the merchandising platform 40 is shaped in the form of an "I" when viewed from above. In other constructions, the merchandising platform 40 may have other forms.

With continued reference to FIG. 1, the merchandising platform 40 includes a plurality of merchandising or advertising or marketing areas 55 that are visible to consumers for advertising products located in the product display areas 35. Each merchandising area 55 defines one or more spaces in which merchandising information (e.g., corporate logos, advertisements, sale information, brand names, etc.) can be displayed. Multiple spaces can be combined to allocate a larger portion of the respective merchandising areas 55 to desired merchandising information.

Figure 3:
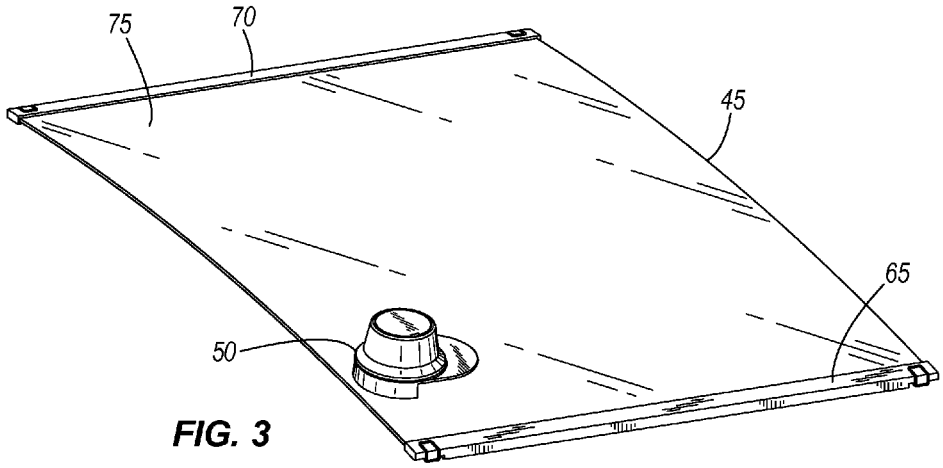
FIG. 3 is a perspective view of one lid and one handle assembly of FIG. 1.
Figure 4:
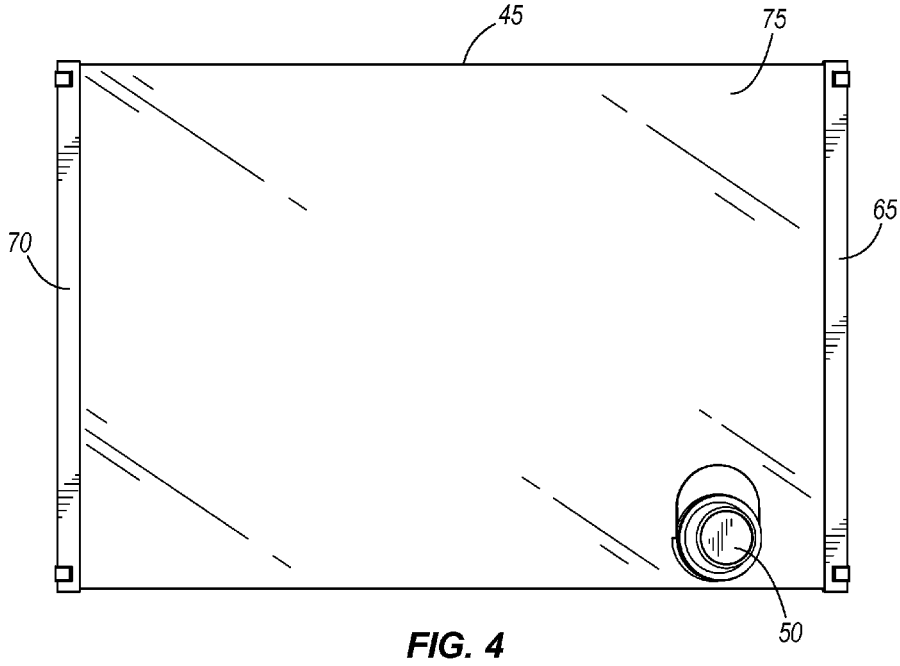
FIG. 4, is a top view of the lid and the handle assembly of FIG. 3.
Figure 5:
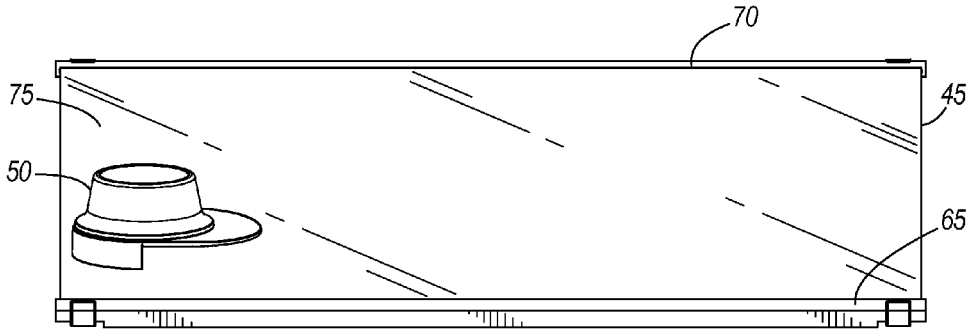
FIG. 5 is a front view of the lid and the handle assembly of FIG. 3.
Figure 6:
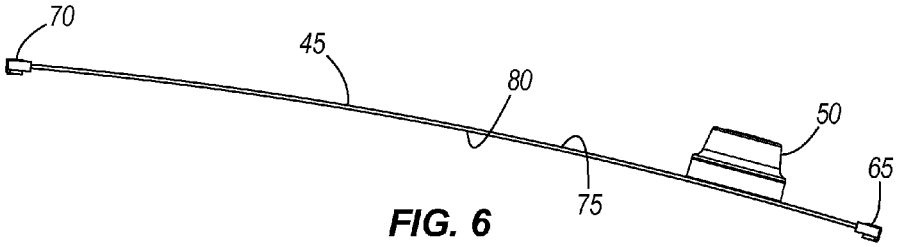
FIG. 6 is a side view of the lid and the handle assembly of FIG. 3.

FIGS. 1 and 2 show that each lid 45 covers a portion of one product display area 35, and is movable between an open position allowing access to the product display area 35 and a closed position limiting access to the product display area 35. As shown in FIGS. 2 and 3, each lid 45 includes a front edge portion 65 that is slidable along the top of the side panels 25, and a rear edge portion 70 that is slidable along a support surface defined by the internal walls 30 below the merchandising platform 40. As one of ordinary skill in the art will recognize, depending on the desired opening direction, the lids 45 slide under or over adjacent lids 45 to facilitate access to the product display areas 35. The lids 45 that slide over adjacent lids 45 are defined as upper lids 45*a* of the merchandiser 10, and the lids 45 that slide under adjacent lids 45 are defined as lower lids 45*b* of the merchandiser 10.

FIGS. 3-6 show one lid 45 and the corresponding handle assembly 50. The lid 45 is formed from a transparent material to allow viewing of food product in the product display area 30 with the lid 45 in the closed position. The lid 45 includes a first surface 75 exposed to and facing the ambient environment, and a second surface 80 in communication with and facing the product display area 35. As illustrated in FIGS. 3-6, the lid 45 is curved from the front edge portion 65 to the rear edge portion 70. In other constructions, the lid 45 may be flat.

FIGS. 3-6 show the handle assembly 50 attached to the lid 45 adjacent the left edge of the lid 45 and the front edge portion 65. Alternatively, the handle assembly 50 can be positioned adjacent the right edge of the lid 45 (see FIG. 1). Generally, whether the handle assembly 50 is located along the left edge or the right edge of the corresponding lid 45 depends on the desired opening and closing direction for the lid 45. Also, the handle assembly 50 can be positioned anywhere on the lid relative to the front edge portion 65 and the rear edge portion 70.

Figure 7:
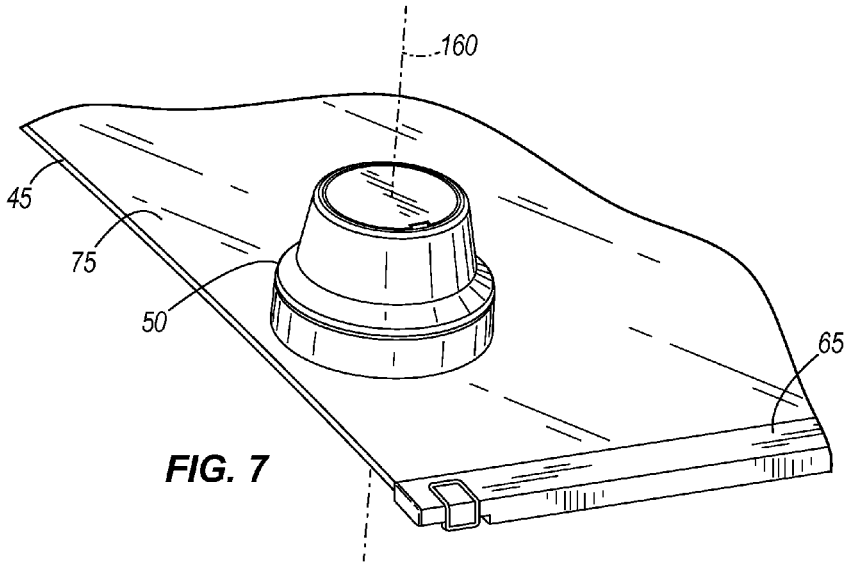
FIG. 7 is a partial perspective view of the lid and the handle assembly of FIG. 3.
Figure 9:
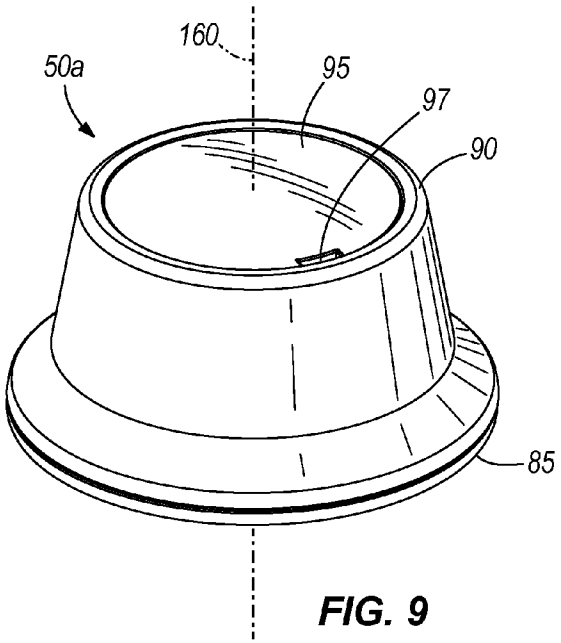
FIG. 9 is an unexploded perspective view of the handle assembly of FIG. 8.
Figure 8:
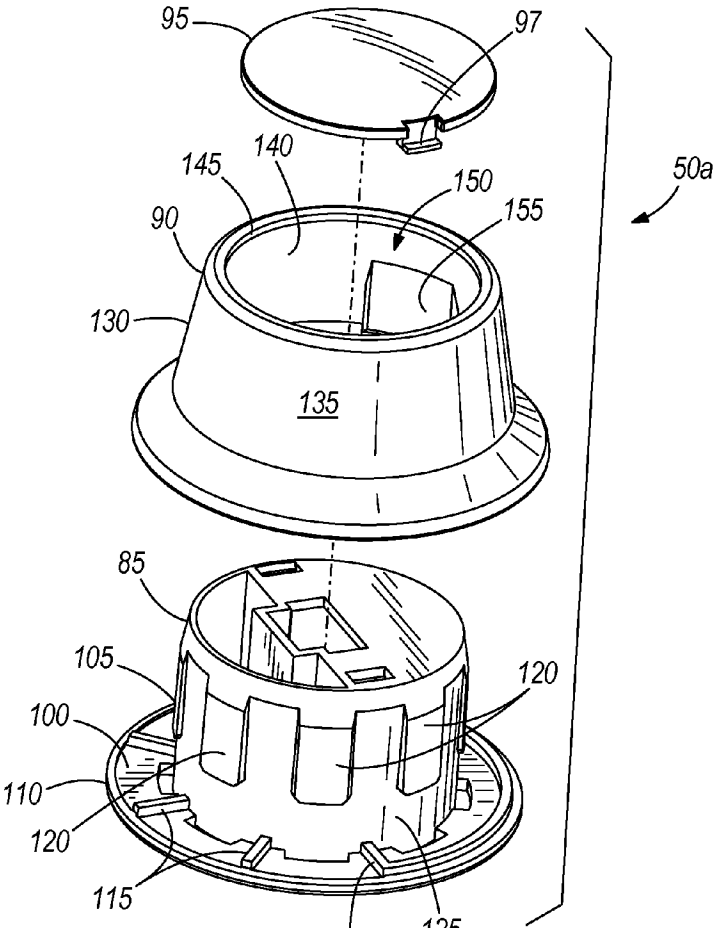
FIG. 8 is an exploded perspective view of one construction of a handle assembly for the merchandiser of FIG. 1.

FIGS. 7-17 show different constructions of the handle assembly 50 that are attachable to the lids 45. FIGS. 8 and 9 show a handle assembly 50*a* attachable to an upper lid 45*a*. The handle assembly 50*a* includes a base 85, a handle 90, and a cap 95. The base 85 is coupled to the lid 45*a* via an attachment clip that is secured to the lid 45*a* using adhesive (e.g., epoxy, double-sided tape, etc.) to support the handle 90 on the lid 45*a*. In other constructions, the base 85 may be adhered directly to the lid 45*a*. In still other constructions, the base 85 may be attached directly or indirectly to the lid 45*a* by fasteners (e.g., screws).

The base 85 is relatively thin and includes a cylindrically-shaped platform 100 and a substantially cylindrical central portion or support 105. As shown in FIG. 8, the platform 100 includes a perimeter edge 110 and a plurality of support ridges 115. The central portion 105 includes a plurality of tab members 120 that extend around a circumferential surface 125 of the central portion 105. In the illustrated construction, the tab members 120 define a lip and are evenly spaced apart from each other around the central portion 105. In some constructions, the tab members 120 may be spaced apart at random distances. In other constructions, the base 85 may include a continuous circumferential tab member 120 extending around the central portion 105. Generally, the central portion 105 can include any quantity of tab members 120.

The handle 90 is a substantially cylindrical shell defined by a circumferential wall 130 that has an outer, decorative surface 135 and an inner surface 140. The circumferential wall 130 has a tapered cylindrical shape that enlarges in diameter from the top of the handle 90 toward the bottom of the handle 90. As shown in FIG. 8, an upper part of the wall 130 has a circumferential ridge 145 and defines an opening 150 adjacent the upper part of the wall 130.

The handle 90 also includes tabs 155 disposed on the inner surface 140 and engageable with the tab members 120 to rotatably attach the handle 90 to the base 85. The tabs 155 are spaced apart from each other a distance around the inner surface 140 substantially corresponding to the distance that the tab members 120 are spaced apart along the circumferential surface 125 of the central portion 105. Generally, each tab 155 has a width that is slightly larger than the width of each tab member 120 so that a portion of each tab 155 is always engaged with at least one tab member 120. The length of each tab 155 corresponds to the length of the tab members 120 so that the tabs 155 can engage the tab members 120. In some embodiments, the handle 90 may include one continuous circumferential tab 155 that is engageable with the tab members 120.

Generally, the handle 90 is engageable by an individual to move the lid 45*a* between the open and closed positions. As shown in FIGS. 7 and 9, the handle 90 is rotatable clockwise and counter-clockwise relative to the lid 45*a* and the base 85 about an axis 160 extending vertically and orthogonally through the handle assembly 50. Specifically, the tab members 120 and the tabs 155 cooperate to allow the handle 90 to rotate relative to the base 85 around the axis 160 via sliding engagement of the tabs 155 on the tab members 120. As the handle 90 rotates relative to the base 85, the tabs 155 rotate around the central portion 105 along the lips defined by the tab members 120.

The cap 95 is a thin cylindrical plate that covers the opening 150 to limit entry of dust and other undesired particles into the interior of the handle assembly 50*a*. The cap 95 is snap-fit attached to circumferential ridge 145 of the handle 90 via a tab engagement 97. The illustrated cap 95 is transparent. Alternatively, the cap 95 may be substantially opaque. In some constructions, merchandising information (e.g., brand names, logos, etc.) may be embossed or imprinted on the cap 95. In constructions including the transparent cap 95, merchandising information can be provided on a circular piece of paper or other medium and the transparent cap 95 can be used to encapsulate the merchandising information on the handle 90.

Figure 11:
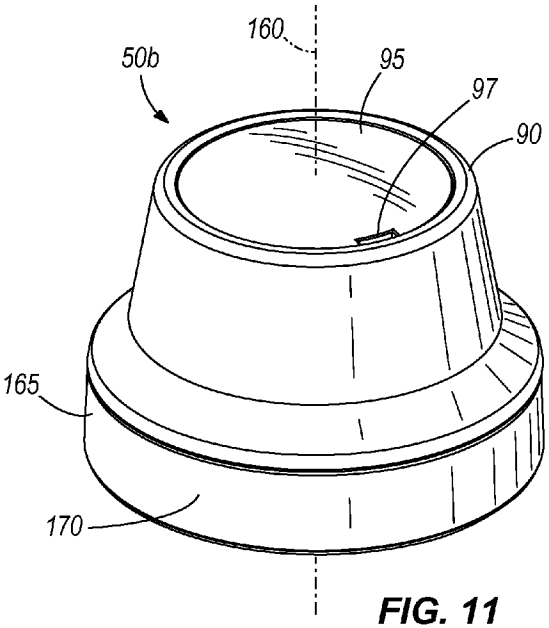
FIG. 11 is an unexploded perspective view of the handle assembly of FIG. 10.
Figure 10:
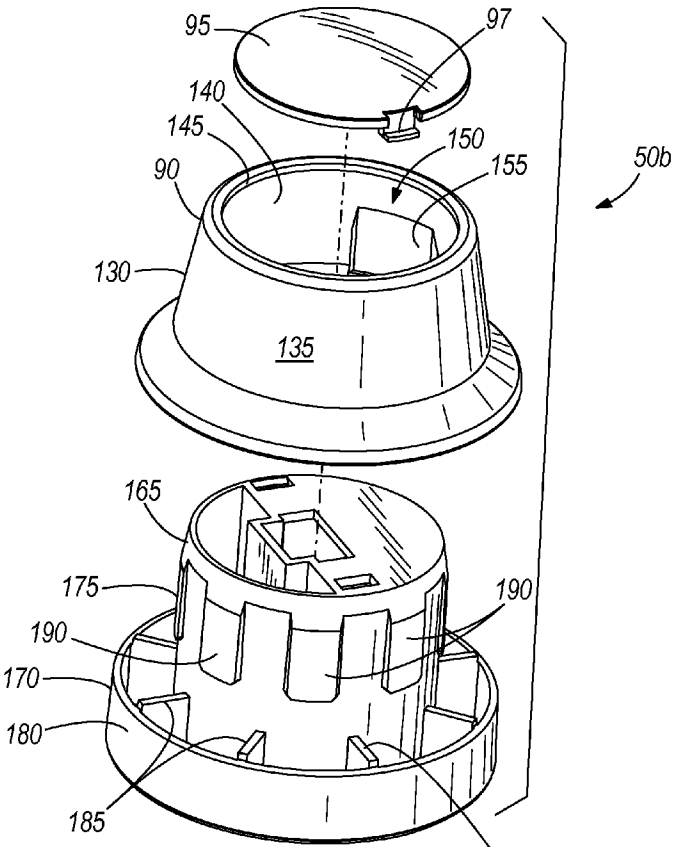
FIG. 10 is an exploded perspective view of another construction of a handle assembly for the merchandiser of FIG. 1.
Figure 12:
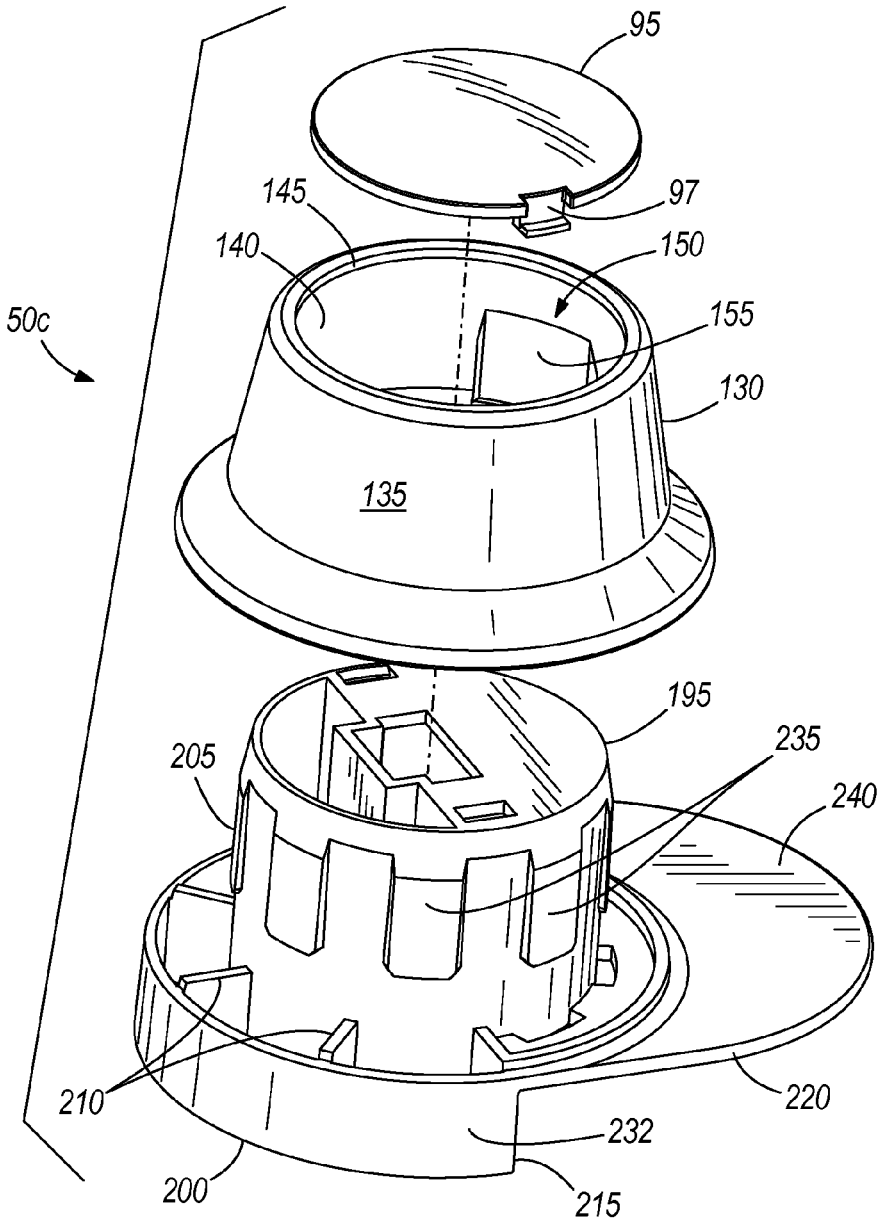
FIG. 12 is an exploded perspective view of another construction of a handle assembly for the merchandiser of FIG. 1.
Figure 13:
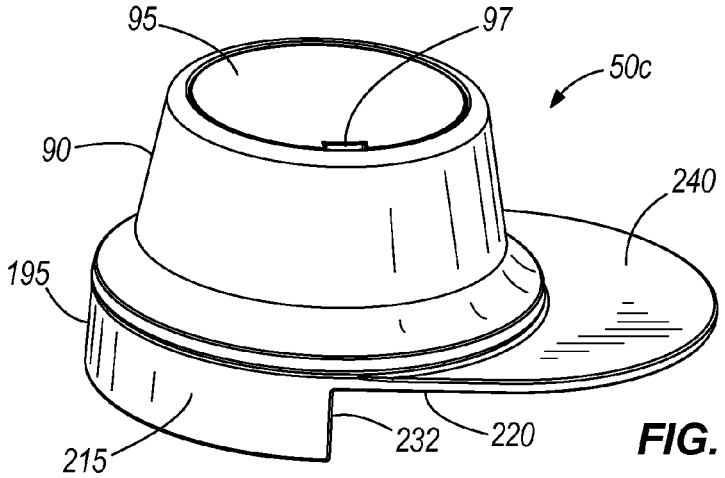
FIG. 13 is an unexploded perspective view of the handle assembly of FIG. 12.

FIGS. 10 and 11 show another construction of a handle assembly 50*b* that is attachable to a lower lid 45*b*. Except as described below, the handle assembly 50*b* is the same as the handle assembly 50*a* described with regard to FIGS. 8 and 9, and like elements are given the same reference numerals.

Figure 23:
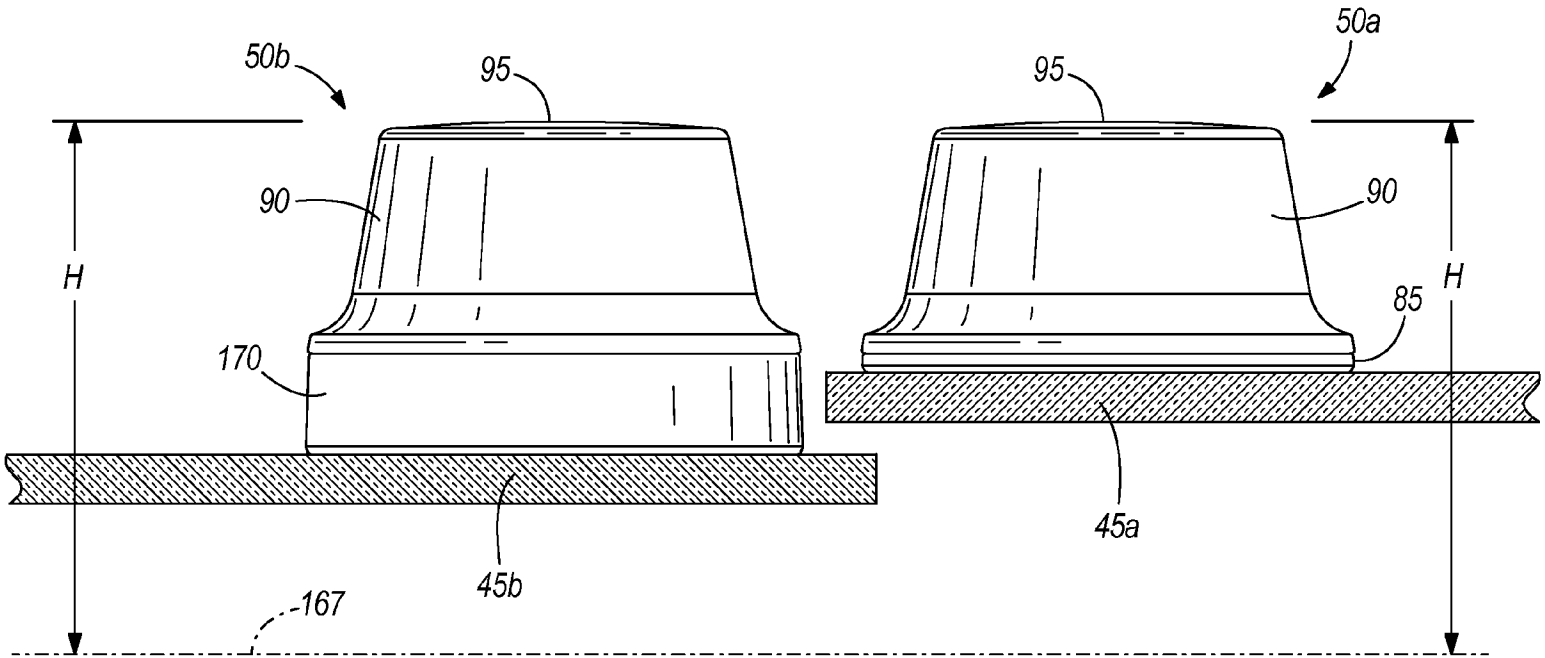
FIG. 23 is a section view of a portion of the merchandiser of FIG. 2.

The handle assembly 50*b* includes the handle 90, the cap 95, and a base 165. The base 165 is attached to the lid 45*b* in the same manner as the base 85 is attached to the lid 45*a* (e.g., directly or indirectly using adhesive or fasteners), and the base 165 is taller relative to the base 85 such that when the handle assembly 50*b* is attached to the lower lid 45*b* as illustrated in FIGS. 1, 2, and 23, the cap 95 of the handle assembly 50*a* and the cap 95 of the handle assembly 50*b* are located on the same horizontal plane above a support surface 167 of the merchandiser 10. Stated another way, the top of the handle assemblies 50*a*, 50*b* are at substantially the same height H relative to the support surface 167.

The base 165 includes a cylindrically-shaped platform 170 and a substantially cylindrical central portion or support 175. As shown in FIG. 10, the platform 170 is relatively thick or tall so that the overall handle assembly 50*b* is taller than the handle assembly 50*a*. The platform 170 includes a perimeter edge 180 and a plurality of support ridges 185. The central portion 175 includes a plurality of tab members 190 that are the same as the tab members 120. The handle 90 is rotatably attachable to the base 165 via the tabs 155 and the tab members 190 in the same manner as described with regard to FIGS. 8 and 9.

FIGS. 12-16 show another construction of a handle assembly 50*c* that is attachable to a lower lid 45*b*. Except as described below, the handle assembly 50*c* is the same as the handle assembly 50*b* described with regard to FIGS. 10 and 11, and like elements are given the same reference numerals. Generally, the handle assemblies 50*b*, 50*c* are interchangeable such that either or both handle assemblies 50*b*, 50*c* can be used on the lower lids 45*b* of the merchandiser 10.

The handle assembly 50*c* includes the handle 90, the cap 95, and a base 195. The base 195 is attached to the lid 45*b* (e.g., via fasteners or adhesive), and includes a platform 200 and a substantially cylindrical central portion or support 205. The platform 200 includes a plurality of support ridges 210, a relatively thick first portion 215 defined by a semi-cylindrical shape, and a relatively thin second portion 220 extending from the first portion 215. The thickness of the first portion 215 is such that when the handle assembly 50*c* is attached to the lower lid 45*b*, the cap 95 of the handle assembly 50*a* and the cap 95 of the handle assembly 50*c* are at substantially the same horizontal plane (i.e., the top of the handle assemblies 50*a*, 50*b* are at substantially the same height above the support surface of the merchandiser 10).

Figure 14:
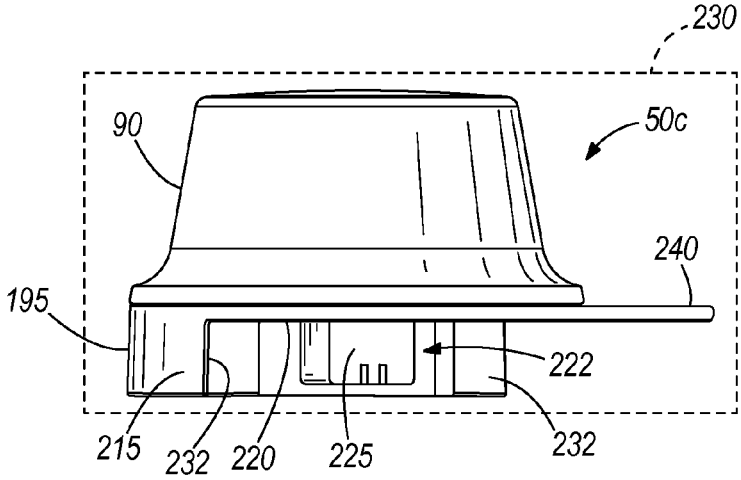
FIG. 14 is another unexploded perspective view of the handle assembly of FIG. 12.
Figure 15:
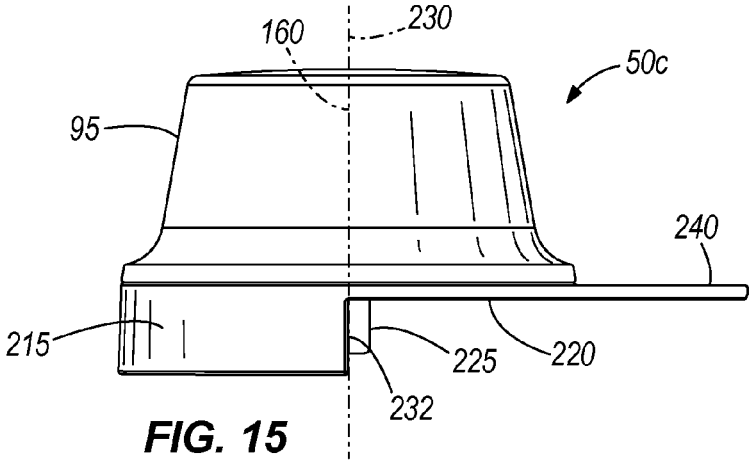
FIG. 15 is a side view of the handle assembly of FIG. 12.
Figure 16:
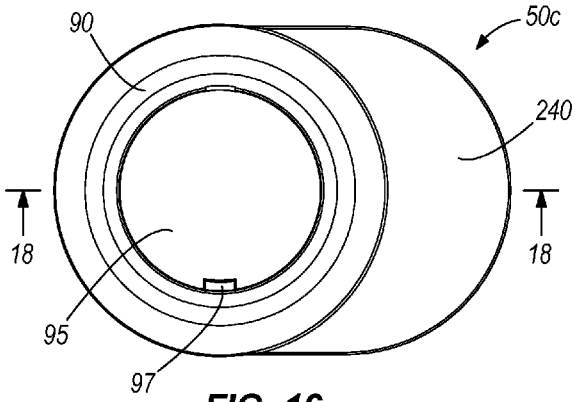
FIG. 16 is a top view of the handle assembly of FIG. 12.
Figure 18:
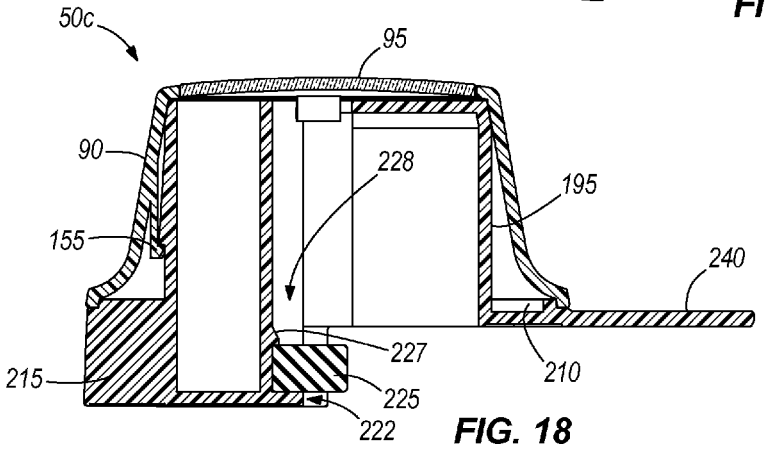
FIG. 18 is a section view of the handle assembly of FIG. 16, taken along line 18-18.
Figure 19:
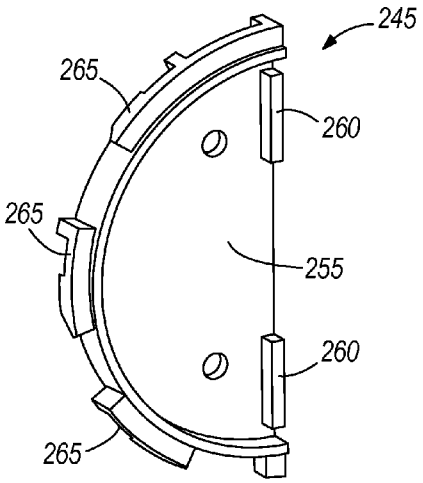
FIG. 19 is a perspective view of an attachment clip of the handle assembly of FIG. 12.
Figure 20:
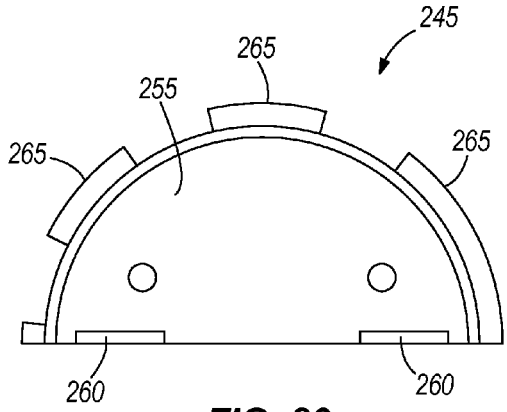
FIG. 20 is a top view of the attachment clip of FIG. 19.
Figure 21:
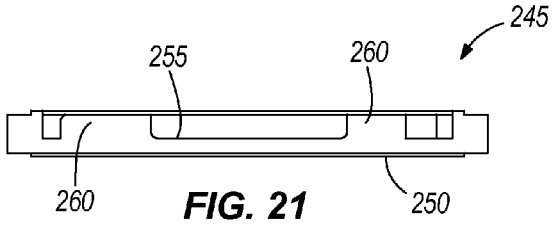
FIG. 21 is a side view of the attachment clip of FIG. 19.
Figure 22:
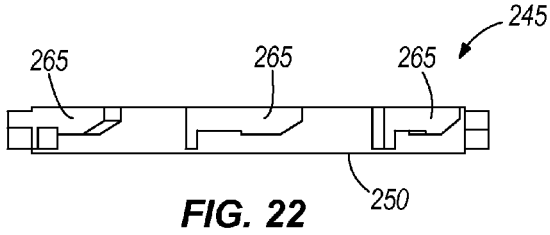
FIG. 22 is another side view of the attachment clip of FIG. 19.

As shown in FIGS. 13, 14, 15, and 18, the platform 200 defines a recess 222 near a center of the platform 200. A stop member 225 extends from the platform 200 from within the recess 222 and is coupled to the platform 200 by an engagement member 227 that holds the stop member 225 in position. As illustrated in FIG. 18, the stop member 225 is inserted and coupled to the platform 200 via sliding engagement within a channel 228 defined by the platform 200 adjacent a bottom of the base 195. As shown in FIGS. 14 and 15, the stop member 225 extends outward from a vertical plane 230 defined by edges 232 of the platform 200. In illustrated construction, the vertical plane 230 is aligned with the axis 160. The stop member 225 is positioned to contact or abut the adjacent upper lid 45*a* when the corresponding lower lid 45*b* is moved from the closed position to the open position so that the lid 45*a* does not touch the handle assembly 50*c*. In some constructions of the handle assembly 50*c*, the base 195 may be without the stop member 225.

The central portion 205 includes a plurality of tab members 235 that are the same as the tab members 120. The handle 90 is rotatably attachable to the base 195 via the tabs 155 and the tab members 235 in the same manner as described with regard to FIGS. 8 and 9.

Figure 17:
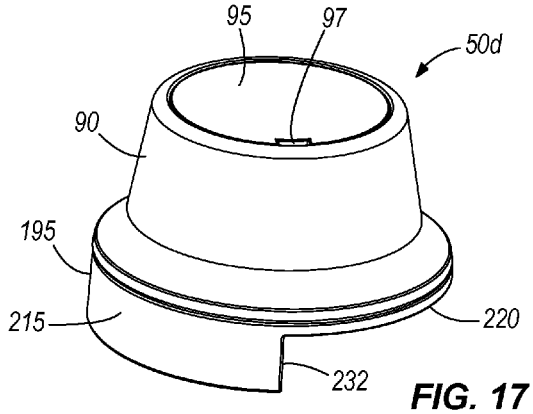
FIG. 17 is an unexploded perspective view of another construction of a handle assembly for the merchandiser of FIG. 1.

As illustrated in FIGS. 12-16, the handle assembly 50*c* also includes a guard or protector 240 extending from the platform 200. FIG. 17 shows another handle assembly 50*d* that is the same as the handle assembly 50*c*, except the handle assembly 50*d* is without the guard 240. FIGS. 12-16 show that the guard 240 extends from the second portion 220 of the platform 200, and has an outer edge defined by a substantially circular curvature corresponding to the curvature of the platform 200. In other constructions, the guard 240 may have a different curvature, or the outer side may be substantially rectangular.

FIGS. 19-22 show one construction of an attachment clip 245 that secures the base 195 to the lid 45*a*. Although not shown, the attachment clips used to secure the base 85, 165 to the lids 45 are similar to the attachment clip 245. As illustrated in FIGS. 19-22, the attachment clip 245 has a semi-cylindrical shape generally conforming to the shape of the first portion 215 of the platform 200 so that the attachment clip 245 is substantially hidden from view after the handle assembly 50*c* is assembled onto the lid 45*a*. The attachment clip 245 includes an attachment surface 250 that is engageable with and adhered or otherwise fastened the first surface 75 of the lid 45*a*, and a recessed surface 255 that accommodates and receives a lower portion of the base 195.

The attachment clip 245 also includes alignment projections 260 and locking tabs 265 that secure the base 195 to the attachment clip 245. The alignment projections 260 are positioned along the flat side of the semi-cylindrically shaped clip 245 to align the base 195 relative to the clip 245. The alignment projections 260 are spaced apart from each other and from the edge of the clip 245 to allow slight movement of the base 195 after attachment to the clip 245. The locking tabs 265 are engaged by the base 195 to securely attach the base 195 to the attachment clip 245 via a snap-fit arrangement. The alignment projections 260 and the locking tabs 265 cooperate to limit rotational movement of the base 195 relative to the lid 45*a* and the clip 245 after the base 195 has been secured to the clip 245. In other constructions, the base 195 may be attached to the clip 245 via other attachment means.

To assemble the handle assembly 50*a* onto the lid 45, the base 85 is indirectly attached to the lid 45 via the attachment clip 245, or directly attached to the lid 45*a* using adhesive or other appropriate attachment means. In constructions of the handle assembly 50*a* including an attachment clip similar to the attachment clip 245, the base 85 is generally aligned with the space between the alignment projections 260 and is partially rotated (in the clockwise direction when viewed from above the base 85) relative to the attachment clip to engage the base 85 with the locking tabs 265. After the base 85 is snap-fit into the locking tabs 265, the base 85 is engaged with the recessed surface 255, and the alignment projections 260 and the locking tabs 265 restrict further rotational movement of the base 85 relative to the clip. If desired, the base 85 may be removed from the clip by pressing down on and rotating the base 85 (in the counter-clockwise direction when viewed from above the base 85) to disengage the base 85 from the alignment projections 260 and the locking tabs 265.

The handle 90 is then engaged with or snapped onto the base 85 via the cooperating tab members 120 and tabs 155. The cover 95 can be attached to the handle 90 before or after the handle 90 is attached to the base 85. In constructions including separate marketing information (e.g., on a piece of paper), the marketing information is placed under the cap 95 prior to attachment of the cap 95 to the handle 90 via the tab engagement 97. With regard to the handle assemblies 50*c*, 50*d*, the stop member 225 is attached to the platform 200 by sliding the stop member 225 within the channel 228 beyond the engagement member 227 so that the stop member 225 is securely held to the base 195. The stop member 225 is coupled to the base 195 prior to attaching the handle assembly 50*c*, 50*d* to the lid 45*b*.

The handle assemblies 50*b*, 50*c*, 50*d* are assembled onto the associated lids 45*b* in the same manner that the handle assembly 50*a* is attached to the lid 45*a*. As such, only assembly and attachment of the handle assembly 50*a* has been described in detail. However, it should be understood that the foregoing description of assembly of the handle assembly 50*a* onto the lid 45*a* is equally applicable to assembly of the handle assemblies 50*b*, 50*c*, 50*d* onto the lid 45*b*.

The merchandising platform 40 provides visible advertising and marketing space on the merchandiser 10 that is vertically above the product display areas 35 to attract consumers to the merchandiser 10 and to indicate the types of products supported in the product display areas 35. The merchandising areas 55 can be modified in many different ways to accommodate desired marketing information and effect.

With reference to FIG. 18, the handle 90 rotates relative to the associated lid 45 about the respective bases 85, 165, 195 about the axis 160 when the lid 45 is moved between the open position and the closed position due to the engagement between the tab members 120 and the tabs 155. As the handle 90 rotates, the tabs 155 slide along the lower lip of the tab members 120. Because the tabs 155 are wider than the spaces between the tab members 120, the tabs 155 are always engaged with at least one corresponding tab member 155 to facilitate rotational engagement of the handle 90 to the base 85, 165, 195. Rotation of the handle 90 accommodates the general arc defined by movement of the handle 90 toward and away from an individual who is operating the handle 90 when the individual opens and closes the associated lid 45. In particular, when the lid 45 moves between the open and closed positions, the handle eases stress on the individual by rotating with the natural movement of the individual's arm and hand.

With regard to the handle assemblies 50*c*, 50*d*, which can be attached to the lower lids 45*b*, the semi-cylindrically-shaped platform 200 allows the associated lid 45*b* to be opened farther than the platforms 100, 170 of the respective handle assemblies 50*a*, 50*b*. Specifically, the second portion 220 of the platform 200 defines a space between the platform 200 and the lid 45 after the handle assembly 50*c* is attached to the lid 45*b*. This space is large enough to accommodate or receive an edge of the upper lid 45*a* that is adjacent to the lower lid so that when the lower lid 45*b* is opened, the opening to the product display area 35 is as large as possible. Likewise, when the upper lid 45*a* is moved toward and over the lower lid 45*b*, the upper lid 45*a* is received within the space to provide a relatively large opening to the product display area 35 below the upper lid 45*a*. The stop member 225 contacts the upper lid 45*a* to limit further movement of the upper lid 45*a* toward the handle assemblies 50*c*, 50*d* of the lower lid 45. In addition, the guard 240 protects an individual when the lower lid 45*b* is moved between the open and closed positions by providing space for the individual's hand to rest above the plane of the adjacent upper lid 45*a* while the upper lid 45*a* is opened or closed.

Various features and advantages of the invention are set forth in the following claims.

What is claimed is:

1. A merchandiser comprising:

a case defining a product display area and configured to be supported on a support surface;

a first lid disposed over a first portion of the product display area and movable between an open position providing access to the first portion of the product display area and a closed position limiting access to the first portion of the product display area;

a second lid located adjacent the first lid and disposed over a second portion of the product display area, the first lid and the second lid cooperating with each other to enclose the first and second portions of the product display area, the second lid movable between an open position providing access to the second portion of the product display area and a closed position limiting access to the second portion of the product display area, and the second lid oriented on the case so that the second lid is at least partially disposed under the first lid when one of the first lid and the second lid is moved toward the corresponding open position;

a first handle assembly including a first handle coupled to and rotatable relative to the first lid as the first lid moves between a first lid open position and a first lid closed position;

a second handle assembly including a second handle coupled to and rotatable relative to the second lid as the second lid moves between a second lid open position and a second lid closed position, the first handle and the second handle oriented such that a top of the first handle and a top of the second handle are at the same height above the support surface;

wherein the first handle assembly includes a first handle base non-rotatably attached to the first lid and the second handle assembly further includes a second handle base non-rotatably attached to the second lid, and wherein the first handle is rotatably coupled to the first handle base and the second handle is rotatably coupled to the second handle base; and wherein the second handle base defines a space accommodating an edge of the first lid such that a portion of the first lid is disposed under the second handle when one of the first lid and the second lid is moved to the corresponding open position.

2. The merchandiser of claim 1, wherein the case includes a base and side supports extending from the base, the base and the side supports cooperating to define a plurality of product display areas, wherein the first lid and the second lid are disposed over one of the product display areas, and wherein each of the remaining product display areas includes an additional pair of lids and handle assemblies similar to the first and second lids and the first and second handle assemblies.

3. The merchandiser of claim 2, further comprising a merchandising platform coupled to the case vertically above the product display areas and including a merchandising area visible to consumers for advertising product located in each of the product display areas.

4. The merchandiser of claim 1, wherein each of the first handle base and the second handle base includes a tab member disposed along an outer periphery, and wherein each of the first handle and the second handle includes a tab disposed along an inner periphery and engaged with the corresponding tab member of the first handle base and the second handle base to rotatably attach the first handle and the second handle to the respective handle base via sliding engagement of the tab on the tab member.

5. The merchandiser of claim 4, wherein the second handle base has a guard extending laterally outward from a central portion of the second handle base.

6. The merchandiser of claim 1, wherein the second handle base is taller than the first handle base.

7. The merchandiser of claim 1, wherein the second handle base has a platform defining a central recess, and wherein a stop member is coupled to the base within the central recess and extends outward from an edge of the platform to contact the first lid when one of the first lid and the second lid is moved to the corresponding open position.

* * * * *